US008911522B2

(12) United States Patent
Cleboski et al.

(10) Patent No.: US 8,911,522 B2
(45) Date of Patent: Dec. 16, 2014

(54) METHODS OF FORMING INSERTS AND EARTH-BORING TOOLS

(75) Inventors: Christopher J. Cleboski, Houston, TX (US); Suresh G. Patel, The Woodlands, TX (US); Danny E. Scott, Montgomery, TX (US); L. Allen Sinor, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 490 days.

(21) Appl. No.: 13/176,363

(22) Filed: Jul. 5, 2011

(65) Prior Publication Data

US 2012/0005966 A1 Jan. 12, 2012

Related U.S. Application Data

(60) Provisional application No. 61/361,728, filed on Jul. 6, 2010.

(51) Int. Cl.

| | |
|---|---|
| ***B24D 3/00*** | (2006.01) |
| ***B24B 1/00*** | (2006.01) |
| ***B24D 18/00*** | (2006.01) |
| ***C09K 3/14*** | (2006.01) |
| ***B24D 11/00*** | (2006.01) |
| ***B24D 3/02*** | (2006.01) |
| ***C09C 1/68*** | (2006.01) |
| ***E21B 10/46*** | (2006.01) |
| ***B24D 99/00*** | (2010.01) |

(52) U.S. Cl.

CPC ..... *E21B 10/46* (2013.01); *B24D 99/005* (2013.01)

USPC ..... 51/295; 51/293; 51/307

(58) Field of Classification Search

USPC ..... 51/295, 293, 307

See application file for complete search history.

(56) References Cited

U.S. PATENT DOCUMENTS

| | | | |
|---|---|---|---|
| 2,371,489 | A | 3/1945 | Williams, Jr. |
| 3,316,073 | A | 4/1967 | Kelso |

(Continued)

FOREIGN PATENT DOCUMENTS

| | | | |
|---|---|---|---|
| EP | 0012631 | A1 | 6/1980 |
| EP | 1297928 | A1 | 4/2003 |
| GB | 1014295 | A | 12/1965 |

OTHER PUBLICATIONS

International Search Report for International Application No. PCT/US2011/042952 mailed Dec. 26, 2011, 4 pages.

(Continued)

*Primary Examiner* — James McDonough
(74) *Attorney, Agent, or Firm* — TraskBritt

(57) ABSTRACT

Methods of forming inserts for earth-boring tools include providing a material in a pattern adjacent a strip, arranging a plurality of superabrasive particles proximate the pattern, and securing at least some of the plurality of superabrasive particles to the strip. The material is configured to attract or secure the plurality of superabrasive particles. Some methods may include imparting like charges to each of a plurality of superabrasive particles, placing the plurality of superabrasive particles over a strip, and securing the superabrasive particles to the strip. In some methods, a first plurality of superabrasive particles may be placed in an array between a first strip and a second strip. A second plurality of superabrasive particles may be placed in an array between the second strip and a third strip. Methods of forming earth-boring rotary drill bits include forming an insert and securing the insert to a body of the bit.

17 Claims, 13 Drawing Sheets

(56) References Cited

U.S. PATENT DOCUMENTS

| | | | |
|---|---|---|---|
| 4,574,004 | A | 3/1986 | Schmidt-Ott et al. |
| 4,719,979 | A | 1/1988 | Jones |
| 4,726,718 | A | 2/1988 | Meskin et al. |
| 4,770,907 | A | 9/1988 | Kimura |
| 4,913,247 | A | 4/1990 | Jones |
| 4,917,917 | A | 4/1990 | Yamamoto et al. |
| 4,943,488 | A | 7/1990 | Sung et al. |
| 5,011,514 | A | 4/1991 | Cho et al. |
| 5,025,873 | A | 6/1991 | Cerkovnik |
| 5,049,164 | A | 9/1991 | Horton et al. |
| 5,062,865 | A | 11/1991 | Chen et al. |
| 5,096,465 | A | 3/1992 | Chen et al. |
| 5,143,523 | A | 9/1992 | Matarrese |
| 5,147,001 | A | 9/1992 | Chow et al. |
| 5,151,107 | A | 9/1992 | Cho et al. |
| 5,405,573 | A | 4/1995 | Clark et al. |
| 6,102,140 | A | 8/2000 | Boyce et al. |
| 6,170,583 | B1 | 1/2001 | Boyce |
| 6,171,709 | B1 | 1/2001 | Koizumi et al. |
| 6,238,280 | B1 | 5/2001 | Ritt et al. |
| 6,286,498 | B1 | 9/2001 | Sung |
| 6,394,202 | B2 | 5/2002 | Truax et al. |
| 6,454,027 | B1 | 9/2002 | Fang et al. |
| 6,537,140 | B1 | 3/2003 | Miller et al. |
| 6,655,481 | B2 | 12/2003 | Findley et al. |
| 6,742,611 | B1 | 6/2004 | Illerhaus et al. |
| 6,843,333 | B2 | 1/2005 | Richert et al. |
| 7,350,599 | B2 | 4/2008 | Lockwood et al. |
| 7,497,280 | B2 | 3/2009 | Brackin et al. |
| 7,776,256 | B2 | 8/2010 | Smith et al. |
| 7,802,495 | B2 | 9/2010 | Oxford et al. |
| 2002/0194955 | A1 | 12/2002 | Fang et al. |
| 2003/0084894 | A1 | 5/2003 | Sung |
| 2004/0112359 | A1* | 6/2004 | Sung ..... 125/15 |
| 2004/0154840 | A1 | 8/2004 | Azar et al. |
| 2004/0235406 | A1 | 11/2004 | Duescher |
| 2005/0025973 | A1* | 2/2005 | Slutz et al. ..... 428/408 |
| 2006/0081402 | A1 | 4/2006 | Lockwood et al. |
| 2007/0102198 | A1 | 5/2007 | Oxford et al. |
| 2007/0102199 | A1 | 5/2007 | Smith et al. |
| 2008/0202821 | A1 | 8/2008 | McClain et al. |
| 2008/0282618 | A1 | 11/2008 | Lockwood |
| 2010/0122853 | A1 | 5/2010 | Scott et al. |
| 2010/0187011 | A1 | 7/2010 | Jurica et al. |
| 2010/0230174 | A1 | 9/2010 | Scott et al. |

OTHER PUBLICATIONS

International Written Opinion for International Application No. PCT/US2011/042952 mailed Dec. 26, 2011, 4 pages.

International Preliminary Report on Patentability for International Application No. PCT/US2011/042952 dated Jan. 8, 2013, 5 pages.

* cited by examiner

METHODS OF FORMING INSERTS AND EARTH-BORING TOOLS

CROSS-REFERENCE TO RELATED APPLICATION

This application claims the benefit of U.S. Provisional Patent Application Ser. No. 61/361,728, filed Jul. 6, 2010 and entitled "Earth-Boring Tools and Intermediate Structures Formed During Fabrication Thereof Having a Controlled Distribution of Superabrasive Particles and Methods of Forming the Same," the disclosure of which is incorporated herein in its entirety by this reference.

FIELD

Embodiments of the present disclosure relate generally to earth-boring tools for drilling subterranean formations such as drill bits, and to methods of forming such earth-boring tools.

BACKGROUND

Wellbores are formed in subterranean formations for various purposes including, for example, the extraction of oil and gas from a subterranean formation and the extraction of geothermal heat from a subterranean formation. A wellbore may be formed in a subterranean formation using a drill bit, such as, an earth-boring rotary drill bit. Different types of earth-boring rotary drill bits are known in the art, including, for example, fixed-cutter bits (which are often referred to in the art as "drag" bits), rolling-cutter bits (which are often referred to in the art as "rock" bits), impregnated bits (impregnated with diamonds or other superabrasive superabrasive particles), and hybrid bits (which may include, for example, both fixed cutters and rolling cutters).

An earth-boring drill bit is typically mounted on the lower end of a drill string and is rotated by rotating the drill string at the surface or by actuation of downhole motors or turbines, or by both methods. The drill string may comprise a series of elongated tubular segments connected end-to-end that extends into the wellbore from the surface of the formation. When weight is applied to the drill string and consequently to the drill bit, the rotating bit engages the formation and proceeds to form a wellbore. The weight used to push the drill bit into and against the formation is often referred to as the "weight-on-bit" (WOB). As the drill bit rotates, the cutters or abrasive structures thereof cut, crush, shear, and/or abrade away the formation material to form the wellbore. A diameter of the wellbore farmed by the drill bit may be defined by the cutting structures disposed at the largest outer diameter of the drill bit.

Different types of bits work more efficiently against formations having different hardnesses. For example, bits containing inserts that are designed to shear the formation, such as fixed-cutter bits, frequently drill formations that range from soft to medium hard. These inserts often have polycrystalline diamond compacts (PDCs) as their cutting faces.

Roller cone bits are efficient and effective for drilling through formation materials that are of medium to high hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder formation materials, the mechanism commonly used for drilling changes from shearing to abrasion.

For abrasive drilling, bits having fixed, abrasive elements are preferred, such as diamond-impregnated bits. While bits having abrasive polycrystalline diamond cutting elements are known to be effective in some formations, they have been found to be less effective for hard, very abrasive formations. For these types of formations, cutting structures that comprise particulate diamond, or diamond grit, impregnated in a supporting matrix are generally more effective.

During abrasive drilling with a diamond-impregnated bit, diamonds or other superabrasive particles scour or abrade away concentric grooves while the rock formation adjacent the grooves is fractured and removed. Conventional impregnated drill bits typically employ a cutting face composed of superabrasive cutting particles, such as natural or synthetic diamond grit, randomly dispersed within a matrix of wear-resistant material. These diamond particles may be cast integrally with the body of the bit, as by low-pressure infiltration, or may be preformed separately, as by a hot isostatic pressure (HIP) process, to form so-called "segments" which are attached to the bit by brazing or furnaced to the bit body during manufacturing thereof by an infiltration process.

Diamond-impregnated bits may be formed by any one of a number of powder metallurgy processes known in the art. During the powder metallurgy process, abrasive particles (e.g., diamond) and a matrix powder (e.g., tungsten carbide (WC) powder) are placed in a desired location in a mold cavity proximate a wall thereof and infiltrated with a molten binder material (e.g., a copper alloy). Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) elements may also be used.

With respect to the diamond-impregnated material to be incorporated in the bit, diamond granules are formed by mixing diamonds with matrix powder and binder into a paste. The paste is then packed into the desired areas of a mold. The resultant diamond-impregnated portions of the bit often have irregular diamond distribution, with areas having a cluster of too many diamonds and other areas having a lower diamond concentration, or even a void—an area free of diamonds. The diamond clusters may lack sufficient matrix material around them for good diamond retention. The areas devoid of, or low in, diamond concentration may have poor wear properties. Accordingly, bits with uncontrolled diamond distributions may fail prematurely due to uneven wear or fracturing.

Previous attempts to solve the problem of uncontrolled diamond distribution include encapsulating individual diamond granules in a metal matrix material to form particles, each with a diamond granule in the center and an outer shell of metal. Then the encapsulated diamonds are mixed with a powder metal matrix and binder to form the paste, as described above. One example of a similar approach is found in U.S. Pat. No. 7,350,599 to Lockwood et al., issued Apr. 1, 2008. In this way, the individual diamond granules are less likely touch each other or cluster together and are more evenly distributed throughout the resulting paste and diamond-impregnated portions of the drill bit.

BRIEF SUMMARY

In some embodiments, the disclosure includes a method of forming an insert for an earth-boring tool comprising providing a material in a pattern adjacent a strip, arranging a plurality of superabrasive particles proximate the pattern, and securing at least some of the plurality of superabrasive particles to the strip. The material is configured to attract or secure the plurality of superabrasive particles.

A method of forming an insert for an earth-boring tool may comprise imparting like charges to each of a plurality of superabrasive particles, placing the plurality of superabrasive particles over a strip, and securing the superabrasive particles to the strip.

In certain embodiments, a method of forming an insert for an earth-boring tool comprises placing a first plurality of superabrasive particles in an array over a first strip, placing a second strip over the first plurality of superabrasive particles, placing a second plurality of superabrasive particles in an array over the second strip, and placing a third strip over the second plurality of superabrasive particles.

Methods of forming earth-boring rotary drill bits comprise forming an insert and securing the insert to a body of the earth-boring rotary drill bit. Forming an insert comprises forming a material in a pattern over a strip, arranging the plurality of superabrasive particles proximate the pattern, and securing at least some of the plurality of superabrasive particles to the strip. The material in the pattern is configured to attract or secure a plurality of superabrasive particles.

DETAILED DESCRIPTION

Figure 1:
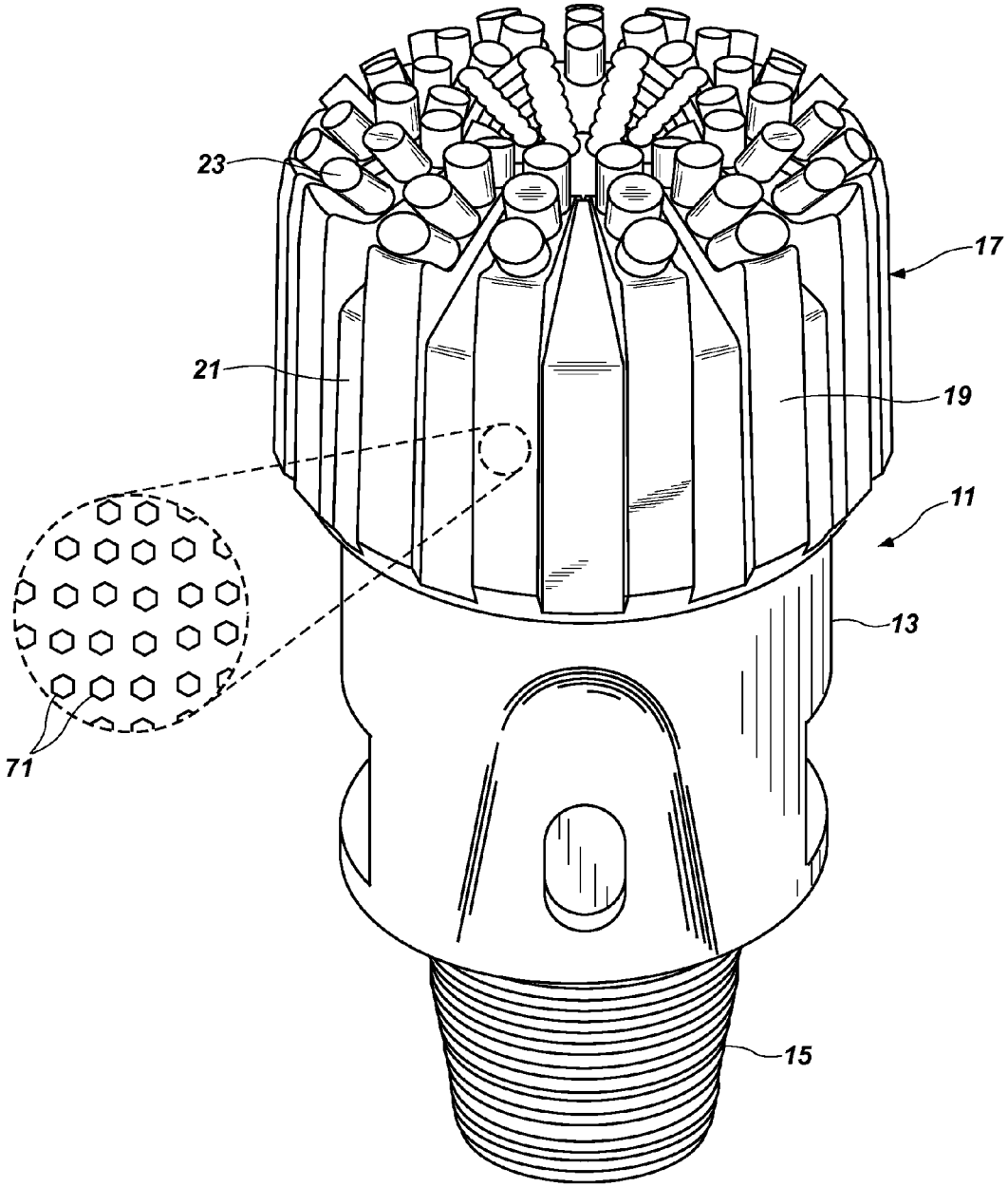
FIG. 1 is a perspective view of an embodiment of an impregnated drill bit according to the present disclosure.

The illustrations presented herein are not meant to be actual views of any particular material, apparatus, system, or method, but are merely idealized representations which are employed to describe certain embodiments of the present disclosure. For clarity in description, various features and elements common among the embodiments of the disclosure may be referenced with the same or similar reference numerals.

As used herein, the term "superabrasive particles" refers to any particles having a Vickers Hardness of at least about 1000 (i.e., at least about 1200HV30, as measured according to ASTM Standard E384 (Standard Test Method for Knoop and Vickers Hardness of Materials, ASTM Int'l, West Conshohocken, Pa., 2010)). Superabrasive particles may include diamond (including thermally stable polycrystalline diamond particles (TSP)), cubic boron nitride (CBN), a combination of diamond and CBN, or any other particles that have similar material hardness. The superabrasive particles may be natural or synthetic, and may be single-crystal particles or polycrystalline particles. Furthermore, the term "superabrasive particles" may refer to particles in a coated or non-coated state (e.g., in an encapsulated or non-encapsulated state). Encapsulated particles may be foliated by such methods as described in as described in Multilayer Coated Abrasive Element for Bonding to a Backing, U.S. Pat. No. 5,049,164, issued Sep. 17, 1991; Low Pressure Bonding of PCD Bodies and Method for Drill Bits and the Like, U.S. Pat. No. 4,943,488, issued Jul. 24, 1990; Encapsulated Diamond Particles, Materials and Impregnated Diamond Earth-Boring Bits Including Such Particles, and Methods of Forming Such Particles, Materials, and Bits, U.S. patent application Ser. No. 12/274,600, filed Nov. 8, 2008, now U.S. Pat. No. 8,069,936, issued Dec. 6, 2011; and Impregnated Bit with Improved Grit Protrusion, U.S. patent application Ser. No. 12/403,734, filed Mar. 13, 2009, now U.S. Pat. No. 8,220,567, issued Jul. 17, 2012, the disclosures each of which are incorporated herein in their entirety by this reference. Coating materials may include, for example, tungsten, tungsten carbide, titanium, titanium carbide, silicon carbide, etc.

The term "impregnated bit," as used herein, refers to any drill bit that includes superabrasive particles on or in at least one surface or bit body of the drill bit, including, for example, fixed-cutter bits, roller cone bits, and diamond-impregnated bits. While the embodiments described herein are earth-boring rotary drill bits, other drill bits, such as percussion bits, are also contemplated by this disclosure. Other types of earth-boring tools, such as reamers, mills, eccentric bits, coring bits, etc., also may embody the present disclosure.

As used herein, the term "distal" refers to the side or end of the drill bit assembly that is furthest from the surface of the formation that is to be drilled during normal operation.

The term "proximal," as used herein, refers to the direction of the drill bit assembly that is closest to the surface of the formation that is to be drilled during normal operation.

The term "strip," as used herein, refers to a body of any shape and size configured to receive superabrasive particles for use in an earth-boring tool. The strips described herein may be thick or thin, wide or narrow, curved or flat, or any other combination of geometries useful for the final application. The strips described herein may be pliable or rigid.

As used herein, "ASTM mesh particles" means particles that pass through an ASTM (American Society for Testing and Materials) mesh screen of a particular size as defined in ASTM specification E11-09, entitled "Standard Specification for Wire Cloth and Sieves for Testing Purposes," which is incorporated herein in its entirety by this reference. For example, a "+400 ASTM mesh particle" is a particle that is retained on, and does not pass through, an ASTM No. 400 mesh screen. A "−400 ASTM mesh particle" is a particle that does pass through an ASTM No. 400 mesh screen.

Referring to FIG. 1, according to one embodiment of the disclosure, an impregnated bit 11 may include a shank 13 of steel with threads 15 formed on its distal end for attachment to a drill string. A diamond-impregnated crown 17 is formed on the proximal end of the shank 13 (i.e., opposite threads 15). The crown 17 may have a variety of configurations. By way of example and not limitation, the crown 17 may have a plurality of blades 19 formed therein, each blade extending along the cylindrical side of the crown 17 and over to a central inverted cone area on the distal end of the crown 17. Blades 19 are separated from each other by junk slots or channels 21 for drilling fluid and cuttings return flow. In the embodiment of FIG. 1, the portion of the blades 19 on the distal end of the crown 17 are divided into segments or posts 23. Alternatively, the crown 17 may have smooth, continuous blades 19 extending to a central nozzle area. The blades 19 and posts 23 may be impregnated with diamonds or other superabrasive particles 71, as described in further detail below, to improve their performance.

Figure 2:
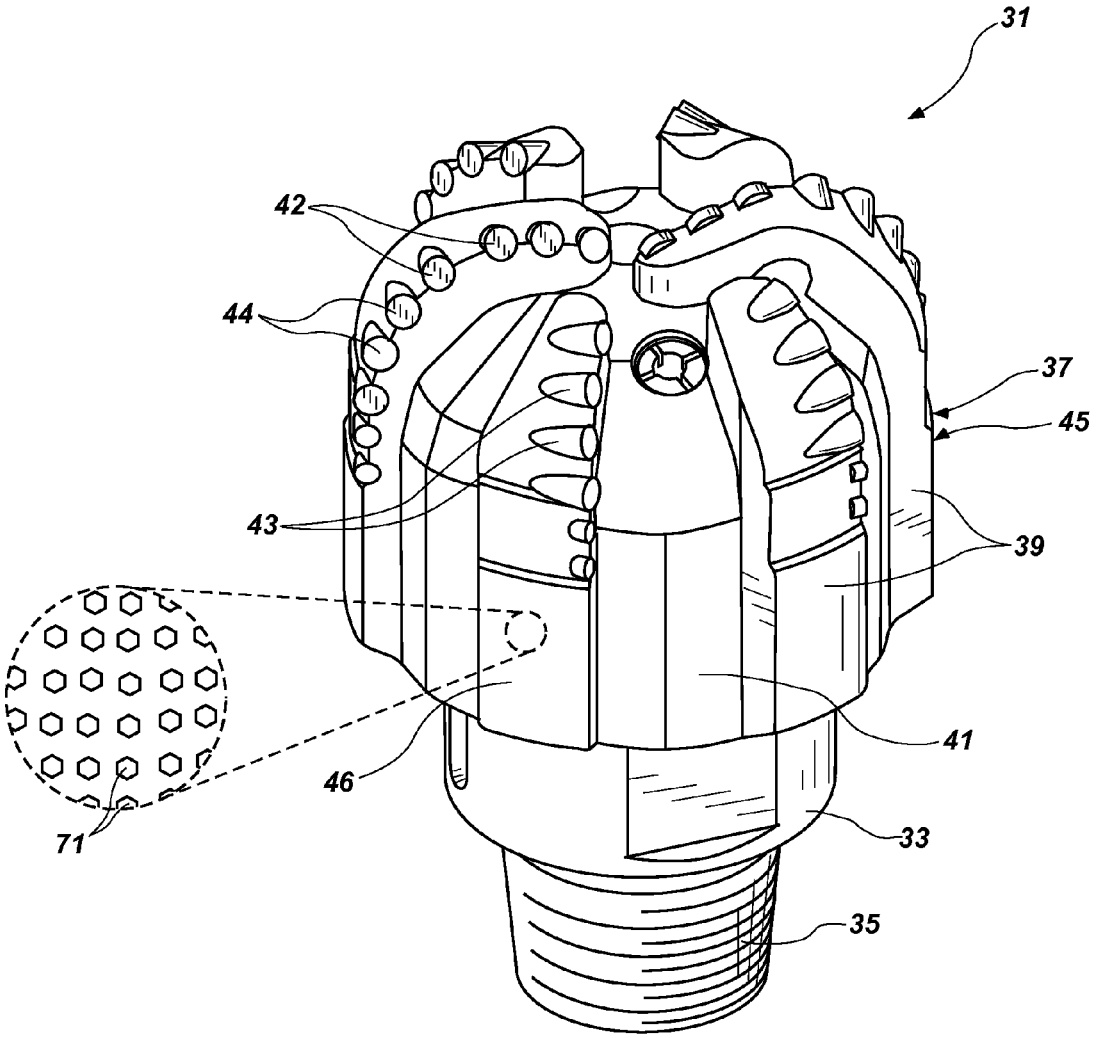
FIG. 2 is a perspective view of an embodiment of a fixed-cutter drill bit according to the present disclosure.

While an impregnated bit 11 used for abrasive drilling is shown in FIG. 1, the disclosure contemplates other embodiments including, for example, fixed-cutter bits and rolling-cutter bits with portions or surfaces including superabrasive particles. By way of example, FIG. 2 shows a fixed-cutter bit 31 according to one embodiment that includes superabrasive particles 71 impregnated in at least one surface (e.g., a gage surface) of the fixed-cutter bit 31. Similar to the impregnated bit 11 described above, the fixed-cutter bit 31 may include a shank 33 of steel with threads 35 formed on its distal end for attachment to a drill string. A fixed-cutter crown 37 is formed on the proximal end of the shank 33 opposite the threads 35. The crown 37 may have a plurality of blades 39 formed therein separated from each other by junk slots or channels 41 for drilling fluid and cuttings return flow. The fixed-cutter bit 31 may also include cutter pockets 42 in the blades 39 configured to receive cutting elements 44. The cutter pockets 42 may include buttresses 43 to support the cutting elements 44 from the rear. Cutting elements 44 may have a face made of polycrystalline diamond compact (PDC) or some other hard material for shearing away the formation to be drilled.

The fixed-cutter bit 31 shown in FIG. 2 may also include a structure referred to as a bit gage 45, defined by gage pads 46. The bit gage 45 may be positioned at the base of blades 39 such that the surface of the bit gage 45 is at the largest diameter of the fixed-cutter bit 31. Therefore, as the fixed-cutter bit 31 rotates and drills through the formation, the bit gage 45 may be engaged with the formation on the walls of the hole that is formed as the fixed-cutter bit 31 drills through the formation. The gage pads 46 may be provided at the bit gage 45 to decrease wear of the base of the blades 39 and to ensure that diameter of the fixed-cutter bit 31 and the resulting diameter of the hole in the formation stay substantially constant as drilling progresses. Therefore, the gage pads 46 may include superabrasive particles 71 and may be formed from superabrasive particle-impregnated strips 91 that will be described in more detail hereinafter.

Figure 3:
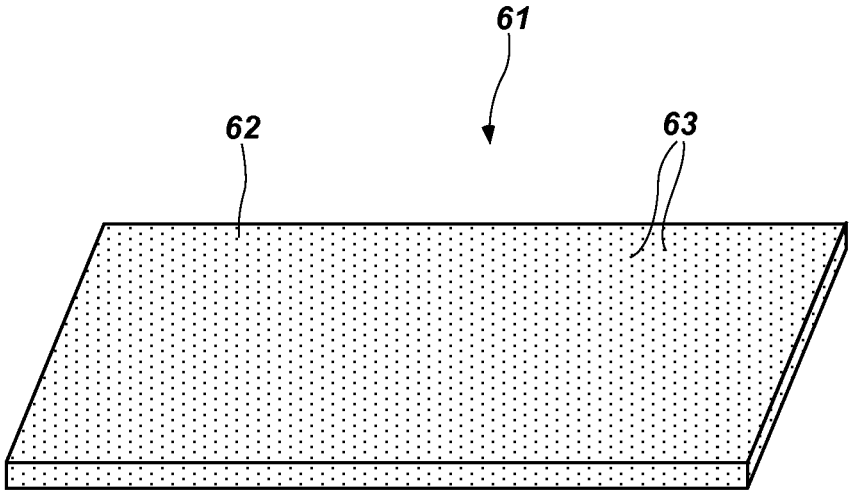
FIG. 3 is a perspective view of a matrix-based strip prepared to receive superabrasive particles in a manner according to the present disclosure.

An embodiment of a process and system for arranging superabrasive particles 71 in a predetermined pattern and controlled manner will now be described. In short, the method includes providing a material in a pattern over a strip, arranging particles proximate the pattern, and securing the particles to the strip. As shown in FIG. 3, a strip 61 (e.g., a matrix-based strip, a paper, a polymer, etc.) may be prepared to receive diamonds or other superabrasive particles 71. Although the strip 61 is shown as a generally flat rectangular material, the strip 61 may have any desired shape or size. For example, in some embodiments, the strip 61 may have an irregular shape to match the feature of the impregnated bit 11 that is to be formed from the strip 61. In other embodiments, the strip 61 may be circular, semicircular, triangular, trapezoidal, etc. The strip 61 may have a major surface that is flat, curved, stepped, or any combination thereof. In addition, the strip 61 may have a generic shape, such as rectangular, that is later shaped by trimming, cold pressing, bending, etc. In other words, the strip 61 may have any shape or size that is convenient for the final application, as will be appreciated by one of ordinary skill in the art.

In some embodiments, it may be advantageous for the strip 61 to comprise a matrix material therein, as discussed in further detail below, that, upon further processing (e.g., infiltration or sintering), will have a sufficient hardness so that superabrasive particles 71 exposed at the cutting face are not pushed further into the matrix material under the high pressures used in drilling. In addition, the matrix may have sufficient bond strength with the superabrasive particles 71 so that the superabrasive particles are not prematurely released. Finally, the heating and cooling time during subsequent sintering, hot-pressing, or infiltration, as well as the maximum temperature of the thermal cycle, may be sufficiently low so that the superabrasive particles embedded in the strip 61 are not thermally damaged during the process.

Therefore, in some exemplary embodiments, the strip 61 may include hard particles 63, which may or may not be characterized as superabrasive particles, bound together by, for example, an organic binder 62. The hard particles 63 may comprise diamond or hard and abrasion resistant ceramic materials such as carbides, nitrides (including cubic boron nitride, or CBN), oxides, and borides (including boron carbide ($B_4C$)). More specifically, the hard particles 63 may comprise carbides and borides made from elements such as W, Ti, Mo, Nb, V, Hf, Ta, Cr, Al, or Si. By way of example and not limitation, materials that may be used to foam the hard particles 63 include tungsten carbide (WC or $W_2C$, including macrocrystalline tungsten carbide and cemented or sintered tungsten carbide), titanium carbide (TiC), tantalum carbide (TaC), titanium diboride ($TiB_2$), chromium carbides, titanium nitride (TiN), vanadium carbide (VC), aluminum oxide ($Al_2O_3$), aluminum nitride (AlN), boron nitride (BN), and silicon carbide (SiC). The strip may be formed by, for example, cold pressing the hard particles 63 and the organic binder 62.

Combinations of different hard particles may be used to tailor the physical properties and characteristics of the particle-matrix composite material of the portion of the drill bit to be impregnated with superabrasive particles 71. For example, alloys and mixtures may also be used, including tungsten alloys such as tungsten/cobalt (W/Co) alloys, tungsten carbide (WC or $W_2C$) or tungsten carbide/cobalt (WC/Co or $W_2C$/Co) alloys in combination with elemental tungsten (e.g., with an appropriate binder phase to facilitate bonding of particles and diamonds). The hard particles 63 may be formed using techniques known to those of ordinary skill in the art. In some embodiments, tougher materials may be applied before harder, more wear resistant particles. For example, tungsten carbide particles may be disposed in a strip 61 under diamond particles for tools intended to drill through steel (e.g., casing) or iron rich formations. Particles may configured as described in Cutting Structures For Casing Component Drillout And Earth-Boring Drill Bits Including Same, U.S. patent application Ser. No. 12/604,899, filed Oct.

23, 2009, now U.S. Pat. No. 8,245,797, issued Aug. 21, 2012, the disclosure of which is incorporated herein in its entirety by this reference.

The binder 62 of the strip 61, shown in FIG. 3, may, in some embodiments, be or include an organic binder. Examples of organic binders include polyethylene, polyethylene-butyl acetate (PEBA), ethylene vinyl acetate (EVA), ethylene ethyl acetate, polyethylene glycol (PEG), polypropylene (PP), poly vinyl alcohol (PVA), polystyrene (PS), polymethyl methacrylate, poly ethylene carbonate (PEC), polyalkylene carbonate (PAC), polycarbonate, poly propylene carbonate (PPC), nylons, polyvinyl chlorides, polybutenes, polyesters, etc. In other embodiments, the binder 62 can include, for example, aqueous and gelation polymers or inorganic polymers. Suitable aqueous and gelation polymers may include those formed from cellulose, alginates, polyvinyl alcohol, polyethylene glycol, polysaccharides, water, and mixtures thereof. Silicone is an example of an inorganic polymer binder. Other binders 62 may include wax or natural and synthetic oil (e.g., mineral oil) and mixtures thereof It is contemplated that one of ordinary skill in the art may find other binders useful for the binder 62 as deemed available and appropriate for binding the hard particles 63 together and for receiving superabrasive particles 71, in the manner described in more detail below.

Thus, in some embodiments, the strip 61 may have the consistency of a paste. In other embodiments, the strip 61 may have the consistency of a flexible elastomer, or of a relatively rigid thermoplastic material. The strip 61 may nevertheless be quite soft when compared to the hardness of the superabrasive particles.

In some embodiments, the strip 61 may comprise a powdered binder material, formed by cold pressing. In other embodiments, the strip 61 may be a thin flexible material, such as paper. The strip 61 with superabrasive particles 71 may be flexible, such that it may conform to surfaces, such as surfaces of molds for forming earth-boring tools.

Figure 4A:
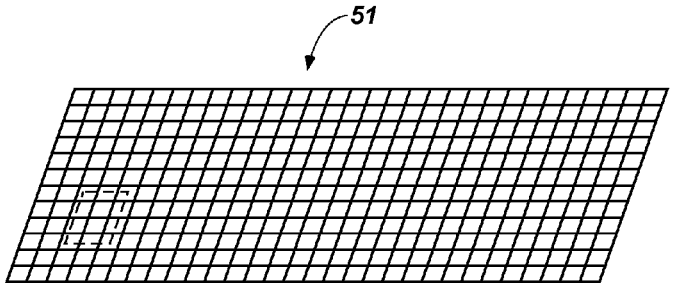
FIG. 4A is a perspective view of a screen for controlling the distribution of superabrasive particles on the strip of FIG. 3.

A material configured to attract or secure superabrasive particles may be provided in a pattern adjacent the strip 61. For example, a template having a plurality of apertures may be placed over the strip 61. A screen 51, as shown in FIGS. 4A through 4E, may be positioned over at least one surface of the strip 61 for arranging diamonds or other superabrasive particles 71 according to a predetermined pattern and in a controlled fashion on and/or in the strip 61. Although FIG. 4A shows the screen 51 in a generally flat rectangular shape, the screen 51 may be any desired shape, including, for example, flat or curved, circular, triangular, trapezoidal, irregular, etc. The shape of the screen 51 may be determined by the shape of an area of an impregnated bit 11, for example, which is to have superabrasive particles 71 distributed in a controlled manner. In other embodiments, it may be desirable for screen 51 to have an overall shape that is larger than the corresponding shape of the strip 61 to be impregnated with superabrasive particles 71, to ensure full coverage of the strip 61 with superabrasive particles 71 arranged in a predetermined pattern.

Figure 4B:
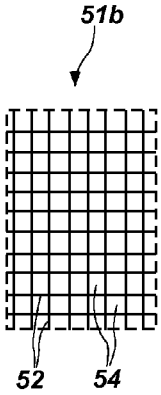
FIGS. 4B through 4E are plan views of various embodiments of the screen of FIG. 4A, detailing a portion of the screen marked by the dotted lines in FIG. 4A.
Figure 4C:
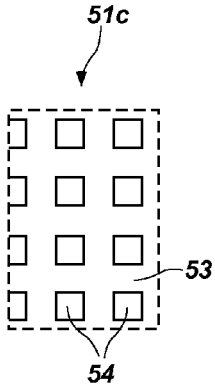
Figure 4D:
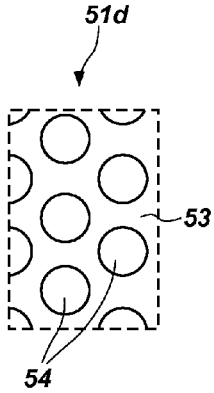
Figure 4E:
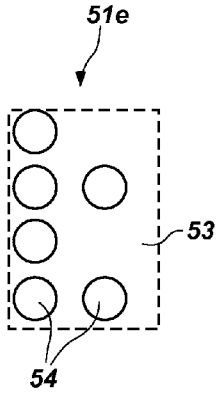

As can be seen in FIGS. 4B through 4E, the screen 51 may be fowled from a variety of materials and in a variety of configurations. The screen 51 may comprise any of a number of suitable materials, including, for example, polymer materials, metal materials, ceramic materials, and combinations of such materials. The screen 51 may have any of a number of configurations, such as those shown in FIGS. 4B through 4E as 51*b* through 51*e*. For example, in one embodiment, the screen 51*b* may be formed with wires or threads 52 woven or overlapping to form a grid structure, as shown in FIG. 4B. In this embodiment, apertures 54 for receiving and allowing passage of superabrasive particles 71 therethrough may extend through the screen 51 and between the wires or threads 52. In other embodiments, shown in FIGS. 4C through 4E, the screen 51*c* through 51*e* may comprise a sheet 53 and a plurality of apertures 54 extending through the sheet 53. The sheet 53 may comprise one or more layers of any of the materials mentioned above. The apertures 54 may be formed in the sheet 53 by various methods. For example, the apertures 54 may be formed by laser ablation, stamping, drilling, cutting, masking and etching, and/or any other suitable method for creating apertures 54 in the sheets 53. In other embodiments, the apertures 54 may be formed during fabrication of the sheets 53, such that no additional processing is needed to form the apertures 54 through the sheets 53 after fabrication of the sheets 53. As shown by way of example in FIG. 4C, the apertures 54 in the screen 51*c* may be generally square in shape. In additional embodiments, as shown in FIGS. 4D and 4E, the apertures 54 may be circular. It is contemplated that the shape of the apertures 54 may be any desired shape, including square, rectangular, triangular, circular, irregular, etc.

Referring again to the embodiment of the screen 51*c* shown in FIG. 4C, the plurality of apertures 54 may be arranged in a rectangular grid pattern, such that the apertures 54 are arranged in discrete rows and columns on the sheet 53. However, in other embodiments, such as that shown in FIG. 4D, the apertures 54 in the screen 51*d* may be arranged at an angle to each other, or, in other words, the apertures 54 in one row may be staggered or shifted in position relative to one or more adjacent rows. Such configurations may allow the superabrasive particles 71 to be positioned in a closer packed arrangement than configurations in which the apertures are arranged in rows and columns, such as shown in FIG. 4C.

In another embodiment shown in FIG. 4E, the apertures 54 may be arranged in an irregular fashion, with a higher concentration of apertures 54 through the sheet 53 in one or more locations on the screen 51*e*, and a lower concentration of apertures 54 through the sheet 53 in other locations on the screen 51*e*. In this manner, the superabrasive particles 71 that will be placed on the strip 61 through the screen 51*e* may be concentrated on the strip 61 as desired, such as, for example, at the leading edge of a blade 19 or post 23.

The apertures 54 shown in FIGS. 4B through 4E may be sized as desired to receive one or more superabrasive particles 71 through each aperture 54. The size and shape of each aperture 54 can be tailored to match or exceed, for example, the mesh size of the superabrasive particles 71. The mesh size of the superabrasive particles 71 may be, for example, from +20 ASTM (American Society for Testing and Materials) to −400 ASTM, or approximately 37 microns to 841 microns in diameter. More specifically, the superabrasive particles 71 may be −40/+50 ASTM mesh particles, or approximately 297 microns to 420 microns in diameter. Alternatively, the superabrasive particles 71 may be −25/+35 ASTM mesh particles, or approximately 500 microns to 707 microns in diameter. In certain embodiments, the mesh size may be as large as necessary to accommodate selected superabrasive particles 71. Thus, the apertures 54 in the screen 51 may be sized to receive one or more superabrasive particles 71 by matching or exceeding the mesh size of the superabrasive particles 71. In some embodiments, it may be desirable to size the apertures 54 so that only one superabrasive particle 71 will fit through each aperture 54 and onto the surface of the strip 61. In such embodiments, each aperture 54 may have a diameter that is slightly larger than the average diameter of superabrasive particles 71, but less than two times the average diameter of the superabrasive particles 71.

Figure 5A:
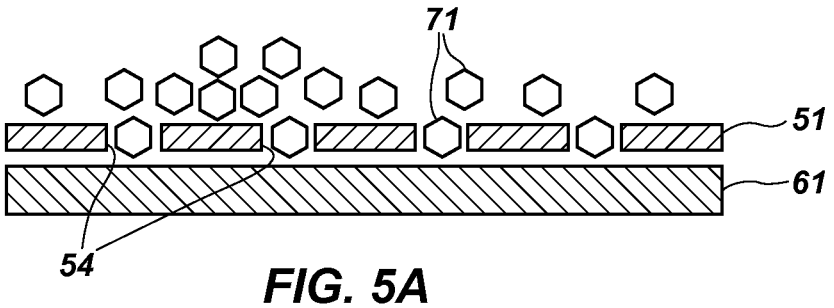
FIGS. 5A through 5F are schematic side views detailing embodiments of a process of controllably distributing superabrasive particles through the screen of FIG. 4A onto the strip of FIG. 3 according to the present disclosure.
Figure 5B:
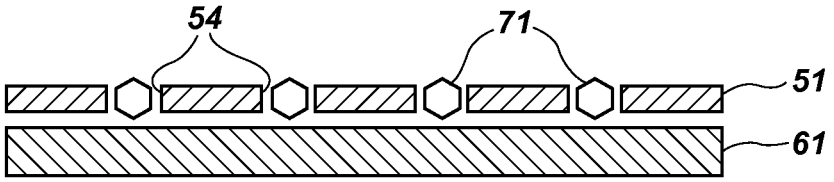

Once the strip 61 and screen 51 are prepared, the screen 51 may be placed over one or more surfaces of the strip 61, as shown in FIG. 5A. Superabrasive particles 71 may then be placed over the screen 51, so that at least some of the superabrasive particles 71 fall into or through the screen 51 and onto the strip 61. Thus, at least some of the superabrasive particles 71 may be placed in the pattern defined by the screen 51. To facilitate the distribution of the superabrasive particles 71 and the filling of the apertures 54, the assembly may be shaken, agitated, tilted, vibrated, pressed, blown with air, etc. Optionally, excess superabrasive particles 71 (i.e., those that have not fallen into apertures 54) may be removed by using a squeegee, scraping, tilting the assembly, blowing, or vacuuming the excess superabrasive particles 71, brushing or shaking the excess superabrasive particles 71 off, etc., resulting in the assembly shown in FIG. 5B. In some embodiments, one superabrasive particle 71 may be disposed at least partially within each aperture 54 of a plurality of apertures 54 through the screen 51. It is not necessary that each and every aperture 54 have a superabrasive particle 71 disposed therein, but it is contemplated that some of the plurality of apertures 54 will each have a superabrasive particle 71 disposed therein. In other embodiments, each and every aperture 54 may have one or more superabrasive particles 71 at least partially disposed therein.

Figure 5C:
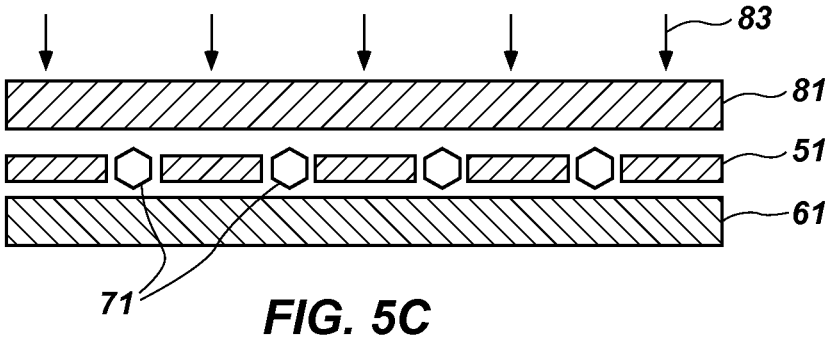
Figure 5D:
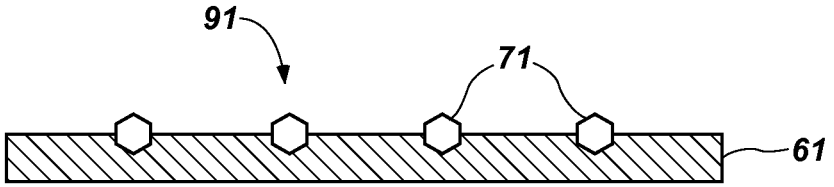

Referring now to FIGS. 5C and 5D, the superabrasive particles 71 may be secured by pressing them into the strip 61. In one embodiment, a plate 81 is placed over the screen 51 and superabrasive particles 71. The plate 81 is pressed against the superabrasive particles 71, as shown by force arrows 83. This forces the superabrasive particles 71 at least partially into the strip 61, as shown in FIG. 5D. The screen 51 may have an average thickness that is less than the average diameter of the superabrasive particles 71. In other embodiments, the screen 51 may have an average thickness that is greater than the average diameter of the superabrasive particles 71, and a punch or rod-like device may be used to push each superabrasive particle 71 through the apertures 54 in the screen 51. For example, the plate 81 may have protrusions or pins on a lower side corresponding to locations of the apertures 54. The plate 81 may be formed of a material that is harder than the strip 61 in its preform state, such as metal, plastic, or ceramic. While FIG. 5C shows the pressing of the superabrasive particles 71 into the strip 61 with a plate 81, it is contemplated that the superabrasive particles 71 may be pressed into the plate 81 in other ways that will be apparent to one of ordinary skill in the art. For example, a roller (not shown) may roll over the surface, pressing the superabrasive particles 71 into the strip 61 as it rolls. In other embodiments, the superabrasive particles 71 may be tapped into place with a device (not shown) of suitable hardness. The screen 51 may optionally be removed prior to or after the pressing of the superabrasive particles 71 into the strip 61. In some embodiments, the screen 51 may stay in place if, for example, it is made of a material (such as a polymer) that may be burned off later in the process, or of a ceramic or metal that may be incorporated into the final product during sintering or infiltration, without significantly compromising the mechanical properties of the final product. In yet other embodiments, the superabrasive particles 71 may be partially pressed into the strip 61 with the screen 51 in place, the screen 51 may then be removed, and the superabrasive particles 71 may finally be pressed further into the strip 61 after the screen 51 is removed.

The resulting structure 91 shown in FIG. 5D may comprise a strip 61 with superabrasive particles 71 distributed in a predetermined pattern partially or fully across at least one surface of the strip 61. The superabrasive particles 71 may be fully embedded (not shown) or partially embedded in the strip 61. This resulting structure 91 may be referred to as a soft insert 91 or green insert 91 because it has not yet been sintered, infiltrated, cured, or otherwise processed to assume its final, hard configuration.

Figure 5E:
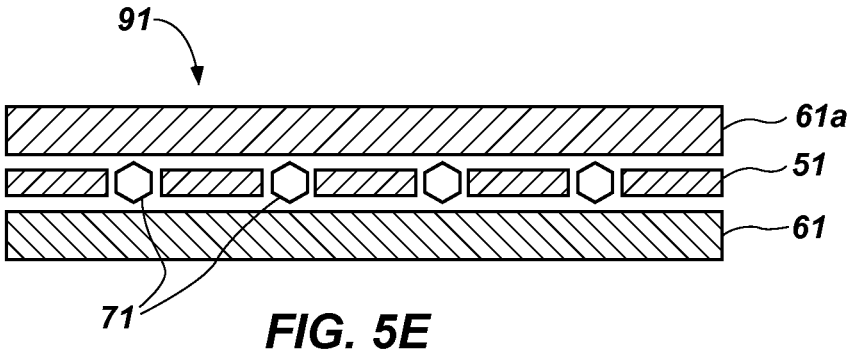
Figure 5F:
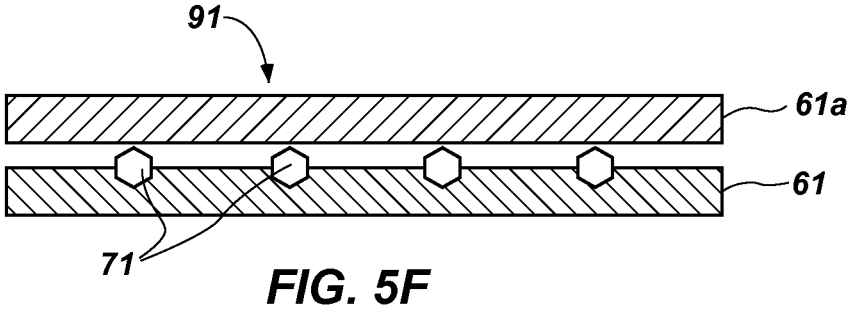

Instead of or in addition to pressing the superabrasive particles 71 into the strip 61, the superabrasive particles may be secured by a second strip 61*a*, as shown in FIGS. 5E and 5F. The second strip 61*a* may have the same or a different composition or dimension as the strip 61. The screen 51 may or may not be removed from the strip 61 before placing the second strip 61 a over the strip 61 and the superabrasive particles 71.

The superabrasive particles 71 may, in some embodiments, be secured to the strip 61 by hot isostatic pressing (HIP), a hot pressing process, an infiltration process, etc.

Figure 6A:
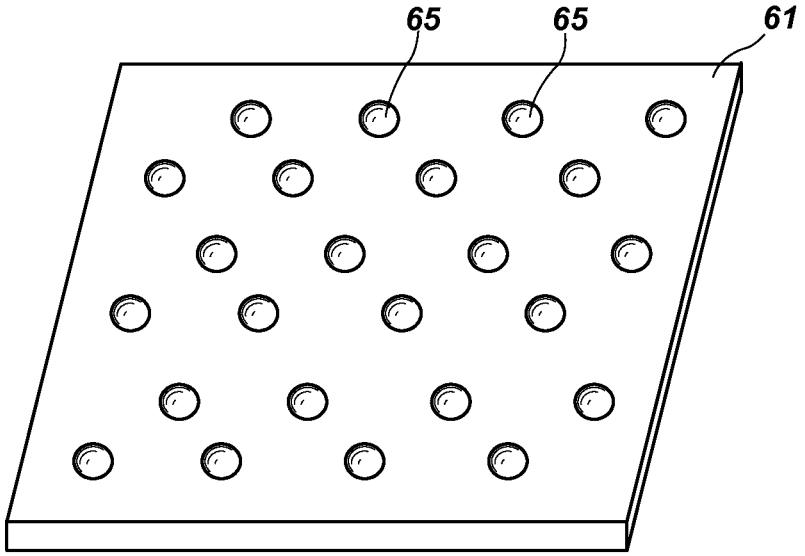
FIGS. 6A through 6D are perspective views detailing embodiments of a process of controllably distributing superabrasive particles in recesses in the strip of FIG. 3 according to the present disclosure.
Figure 6B:
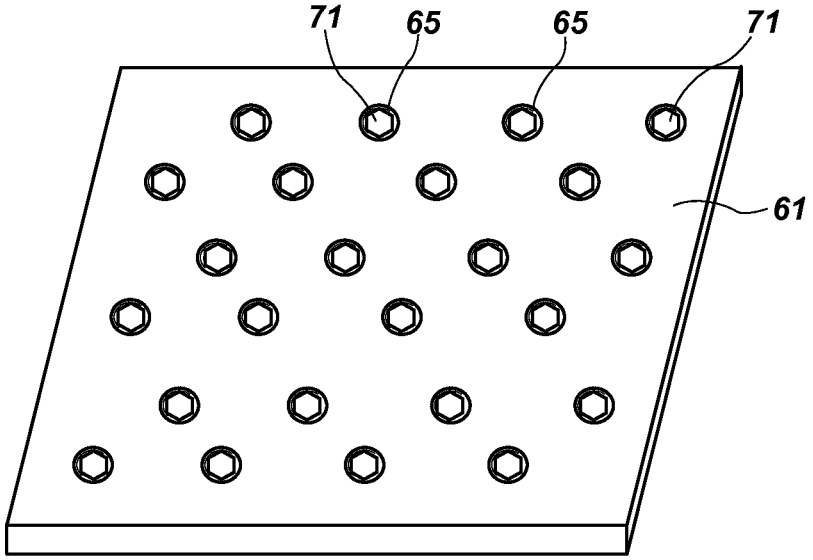

Using the screen 51 described above is but one method of arranging superabrasive particles over a strip 61. In other embodiments, for example as shown in FIG. 6A, a plurality of recesses 65 may be formed in a strip 61. The recesses 65 may be sized as desired to receive one or more superabrasive particles 71 within each recess 65, as shown in FIG. 6B. The size and shape of each recess 65 can be tailored to match or exceed, for example, the mesh size of the superabrasive particles 71. The mesh size of the superabrasive particles 71 may be, for example, from +20 ASTM (American Society for Testing and Materials) to −400 ASTM, or approximately 37 microns to 841 microns in diameter. More specifically, the superabrasive particles 71 may be −40/+50 ASTM mesh particles, or approximately 297 microns to 420 microns in diameter. Alternatively, the superabrasive particles 71 may be −25/+35 ASTM mesh particles, or approximately 500 microns to 707 microns in diameter. The superabrasive particles 71 may be of any selected size and shape. Thus, the recesses 65 in the strip 61 may be sized to receive one or more superabrasive particles 71 by matching or exceeding the mesh size of the superabrasive particles 71. In some embodiments, it may be desirable to size the recesses 65 so that only one superabrasive particle 71 will fit within each recess 65. In such embodiments, each recess 65 may have a diameter that is slightly larger than the average diameter of the superabrasive particles 71, but less than two times the average diameter of the superabrasive particles 71.

Superabrasive particles 71 may then be placed over the strip 61, so that at least some of the superabrasive particles 71 fall into the recesses 65. Thus, at least some of the superabrasive particles 71 may be arranged in a pattern defined by the recesses 65. To facilitate the distribution of the superabrasive particles 71 and the filling of the recesses 65, the assembly may be shaken, agitated, tilted, vibrated, pressed, blown with air, etc. Optionally, excess superabrasive particles 71 (i.e., those that have not fallen into recesses 65) may be removed by using a squeegee, scraping, tilting the assembly, blowing, or vacuuming the excess superabrasive particles 71, brushing or shaking the excess superabrasive particles 71 off, etc., resulting in the assembly shown in FIG. 6B. In some embodiments, one superabrasive particle 71 may be disposed at least partially within each recesses 65 of a plurality of recesses 65. It is not necessary that each and every recess 65 have a superabrasive particle 71 disposed therein, but it is contemplated that some of the plurality of recesses 65 will each have a superabrasive particle 71 disposed therein. In other embodiments, each and every recess 65 may have one or more superabrasive particles 71 at least partially disposed therein.

In some embodiments, the superabrasive particles 71 may be individually placed into recesses 65. For example, an SMT (surface mount technology) component placement system (commonly referred to as a pick-and-place machine) may be used to place superabrasive particles 71 within recesses. The superabrasive particles 71 may be placed concurrently with the formation of the strip 61, such as in a single rapid-prototyping operation.

Figure 6C:
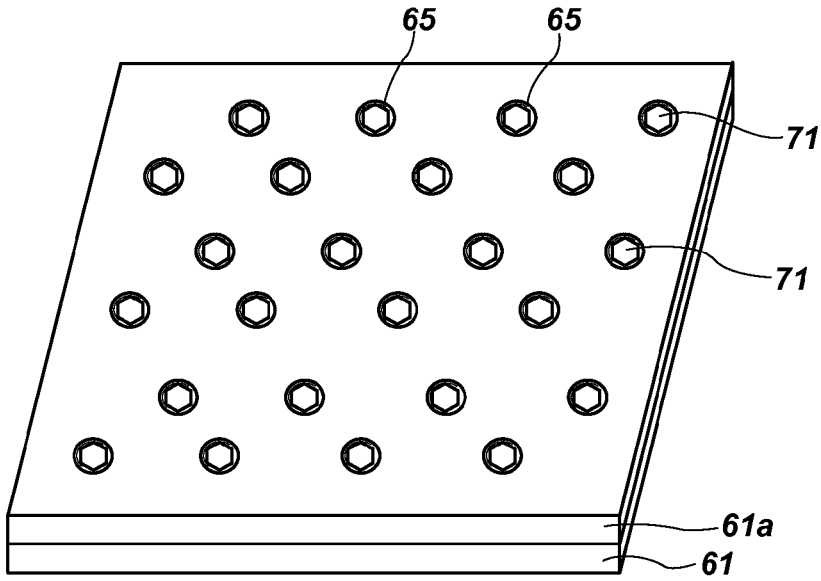
Figure 6D:
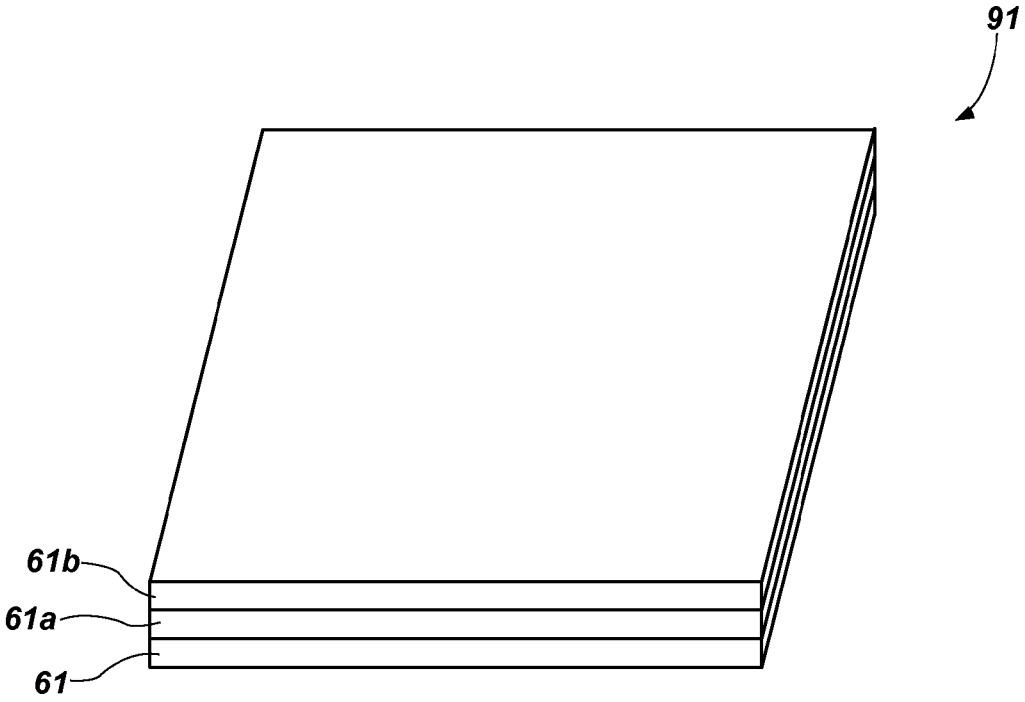

The superabrasive particles 71 disposed within the recesses 65 may then be secured to the strip 61, such as by the pressing methods previously described. For example, as shown in FIG. 6C, a second strip 61*a* may be disposed (e.g., placed or formed) atop the strip 61 and the superabrasive particles 71. The second strip 61*a* may have recesses (not visible in FIG. 6C) on a lower surface of the strip 61*a* arranged to align with the recesses 65 of the first strip 61. When the second strip 61*a* is placed over the strip 61, the recesses on the lower surface of the second strip 61*a* may align with recesses 65 of the first strip 61 to form enclosed cavities in which superabrasive particles 71 are confined. In some embodiments, the depth of the recesses 65 of the first strip 61 or of the second strip 61*a* may be less than half of the average diameter of the superabrasive particles 71, such that at least some of the superabrasive particles 71 become embedded into the first strip 61 and/or the second strip 61*a* when the two strips are pressed together, forming a sandwiched array of superabrasive particles. In some embodiments, the lower surface of the second strip 61*a* may not have recesses therein, and pressing the second strip over the superabrasive particles 71 may cause the superabrasive particles 71 to become embedded into the first strip 61 and/or the second strip 61*a*. The second strip 61*a* may have recesses 65 in an upper surface (e.g., a surface on an opposite side from the side adjacent the first strip 61) configured to accept superabrasive particles 71. The recesses 65 in the upper surface of the second strip 61*a* may be directly above the recesses 65 in the first strip 61, or may be staggered or offset from the recesses 65 in the first strip 61. The size, density, and location of the recesses 65 may be varied to achieve any selected arrangement of superabrasive particles 71. Additional superabrasive particles 71 may be disposed within these recesses 65, and a third strip 61*b*, shown in FIG. 6D, may be applied in the same manner. The superabrasive particles 71 applied over the second strip 61 a may have the same or different sizes, compositions, or coatings than the superabrasive particles 71 applied between the first strip 61 and the second strip 61*a*. Strips and superabrasive particles 71 may be added in as many layers and configurations as necessary to form a green insert 91 having a desired arrangement of superabrasive particles 71.

The strips 61, 61*a*, or 61*b*, and/or the recesses 65 therein, may be formed by, for example, injection molding, powder metal pressing, hydraulic pressing in a mold, rapid prototyping, applying a die or a plate with protruding pins, etc. The strips 61, 61*a*, or 61*b*, and/or the recesses 65 may be formed in situ, or may be separately formed before arrangement with the superabrasive particles 71. The recesses 65 are shown in FIGS. 6A through 6C as dimples (e.g., approximately hemispherical), but may be any shape. The recesses 65 are shown in FIGS. 6A through 6C as distinct, but they may also be connected. For example, the recesses 65 may take the form of an array of connected troughs in a grid or mesh pattern. Superabrasive particles 71 may be placed within the troughs and secured as described above.

Figure 7A:
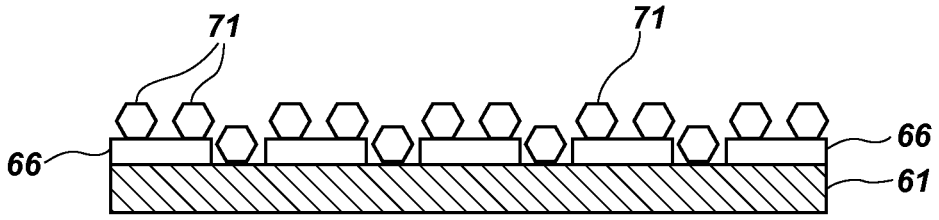
FIGS. 7A and 7B are schematic side views detailing embodiments of a process of controllably distributing superabrasive particles with an adhesive onto the strip of FIG. 3 according to the present disclosure.
Figure 7B:
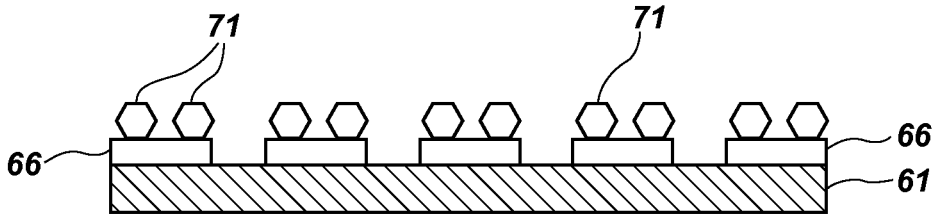

Another method of arranging superabrasive particles 71 over a strip 61 is shown in FIGS. 7A and 7B. In some embodiments, an adhesive 66 may be provided over a strip 61. The adhesive 66 may include a glue, cement, or epoxy, and may be formed in a pattern. For example, an array of glue dots may be applied on the strip 61. In some embodiments, the adhesive 66 may form a grid or mesh pattern. Superabrasive particles 71 may be disposed over the adhesive 66, such as by spreading superabrasive particles 71 over the entire strip 61. Some of the superabrasive particles 71 may be attracted to the adhesive 66 (e.g., may adhere to the adhesive), and other superabrasive particles 71 may not be attracted to the adhesive 66. As shown in FIG. 7B, excess superabrasive particles 71 (e.g., superabrasive particles 71 that are not attracted to the adhesive) may be removed from the strip 61, such as by shaking, agitating, tilting, vibrating, blowing air, vacuuming, brushing, etc. The superabrasive particles 71 may optionally be pressed into the strip 61 for additional security. Multiple strips 61 may be stacked, and may be bonded by another adhesive, a matrix material, etc. The strips 61 may be removed during processing (e.g., by burning or otherwise reacting material of the strip 61), or may ultimately become a part of an earth-boring tool.

Figure 8A:
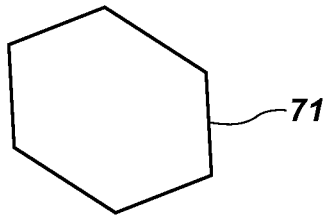
FIGS. 8A through 8C are schematic views of a method of preparing superabrasive particles for electrically charging according to some embodiments of the present disclosure.
Figure 8B:
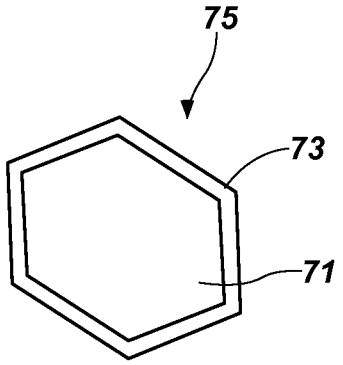
Figure 8C:
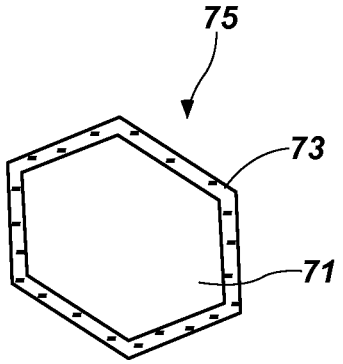

Another method and apparatus for distributing superabrasive particles 71 on and in a strip 61 for inclusion in abrasive applications, such as earth-boring drill bits, will now be disclosed. A strip 61 may be prepared as discussed previously. Instead of using a screen 51 or recesses 65 to align the superabrasive particles 71, the superabrasive particles 71 may be electrically charged, as shown in FIGS. 8A through 8C. Superabrasive particles 71, such as diamonds or cubic boron nitride (CBN) particles, are provided, as shown in FIG. 8A and as described previously. As shown in FIG. 8B, each superabrasive particle 71 may subsequently be coated with a chargeable coating 73. The chargeable coating 73 may be a metal, such as, by way of non-limiting example, iron (Fe), copper (Cu), cobalt (Co), tungsten (W), nickel (Ni), etc. In some embodiments, a chargeable coating 73 of tungsten may provide a desirable bond with the matrix material of the strip 61 or body of the drill bit. The chargeable coating 73 may be formed on the superabrasive particles by chemical vapor deposition (CVD), or by mechanical milling (e.g., ball milling) of the diamond particles with particles of metal (e.g., tungsten metal), as will be appreciated by one of ordinary skill in the art. The chargeable coating 73 may be a thin layer, for example, approximately 5 to 10 microns in thickness around each superabrasive particle 71. The resulting particle is a coated superabrasive particle 75, as shown in FIG. 8B.

Referring to FIG. 8C, the chargeable coating 73 on the superabrasive particles 71 may be electrically charged. The electrical charging of the coated superabrasive particle 75 may be accomplished in any of a number of ways. For example, an electrostatic gun, such as a corona spray gun, may be loaded with the coated superabrasive particles 75. A corona gun produces an electrical discharge brought on by the ionization of the coated superabrasive particles 75 surrounding an electrode, which occurs when the potential gradient exceeds approximately 30 kV per centimeter. The coated superabrasive particles 75 may exit the corona gun and travel near an electrode where they accumulate an electrical charge. As another non-limiting example, a "tribo" gun may be used to charge the coated superabrasive particles 75 by friction. The coated superabrasive particles 75 may be forced or blown through a polytetrafluoroethylene (PTFE) tube and may accumulate an electric charge while rubbing along the walls of the tube. In yet another non-limiting example, the coated superabrasive particles 75 may be loaded into a metal container, and mixed with an aluminum mixing blade mounted on an insulating shaft. The outside of the metal container may be grounded to reduce the risk of capacitive electrostatic discharge from the outside of the vessel. Although the coated superabrasive particles 75 are shown in the figures with a negative electrical charge, it is to be understood that the coated superabrasive particles 75 may be electrically charged with either a negative or a positive charge. Each coated superabrasive particle 75 may have the same charge (i.e., all charged coated superabrasive particles 75 may be positively charged or all charged coated superabrasive particles 75 may be negatively charged). Like charges on the coated superabrasive particles 75 may assist in proper dispersion of the coated superabrasive particle 75.

Figure 9A:
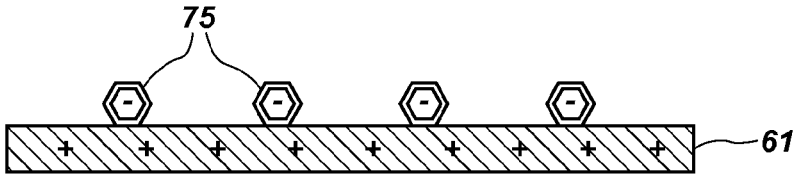
FIGS. 9A through 9D are schematic views of one embodiment of a process of controllably distributing the charged superabrasive particles of FIG. 8C onto the strip of FIG. 3 according to the present disclosure.
Figure 9B:
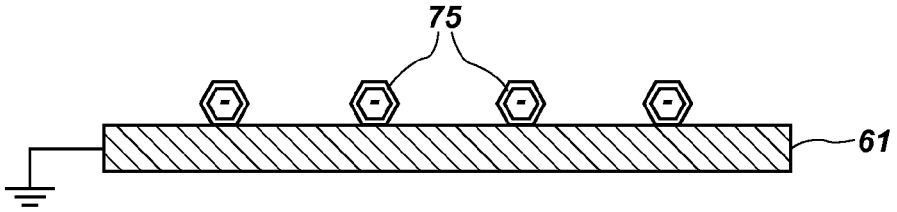

Referring to FIGS. 9A and 9B, a strip 61 may be prepared as described above. The strip 61 may be electrically charged with a charge opposite that of the charged coated superabrasive particles 75 (shown in FIG. 9A), or, alternatively, the strip 61 may be electrically grounded (shown in FIG. 9B). In some embodiments, it may be desirable to ensure that the strip 61 is prepared with a binder, hard particles, or further additives that are electrically conductive so that the strip 61 may hold an electrical charge. After the strip 61 is electrically charged or grounded, the charged coated superabrasive particles 75 may be placed on the charged or grounded strip 61. The opposite charging or the grounding of the strip 61 may tend to attract the charged coated superabrasive particles 75 so they stick to the surface of the strip 61 by the electrical forces involved. In some embodiments, a screen 51 or other physical object may not be necessary to evenly distribute the charged coated superabrasive particles 75 because the similar electrical charge on each coated superabrasive particle 75 will tend to repel the coated superabrasive particles 75 away from each other. In this manner, the charged coated superabrasive particles 75 may distribute themselves across the surface of the strip 61 in a way that reduces, minimizes, or prevents clustering. Agitating the assembly may facilitate the movement and even distribution of the coated superabrasive particles 75 on the surface of the strip 61.

Figure 9C:
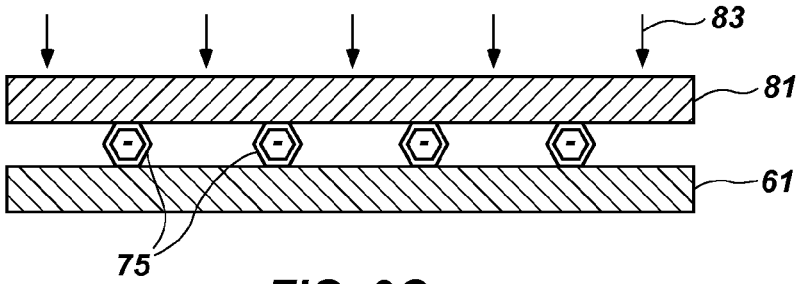
Figure 9D:
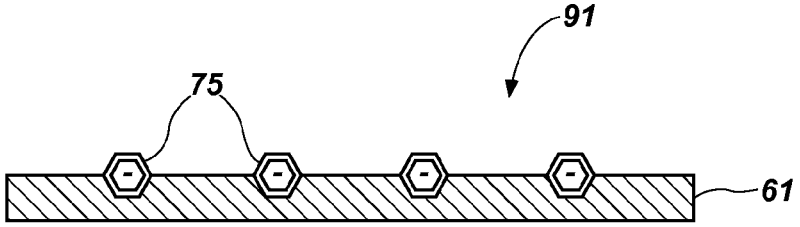

Referring now to FIGS. 9C and 9D, after the coated superabrasive particles 75 are distributed and dispersed on the surface of the strip 61, the coated superabrasive particles 75 may be pressed into the strip 61 with a plate 81 by a force 83, as described previously. In this case, the plate 81 may be formed from an electrically insulating material or with an insulating handle so as to not conduct away the charge of the particles and/or the strip 61. After pressing, the resulting structure 91 may comprise a matrix-based strip 61 with coated superabrasive particles 75 pressed therein and distributed in a controlled manner. As in FIG. 5D, the resulting structure 91 shown in FIG. 9D may be referred to as a soft insert 91 or green insert 91.

Figure 10:
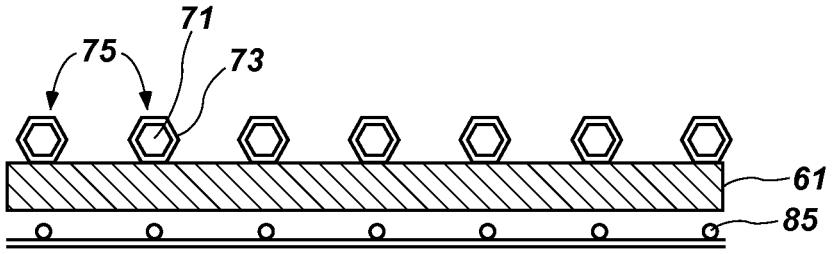
FIG. 10 is a schematic views of one embodiment of a process of controllably distributing the charged superabrasive particles of FIG. 8C onto the strip of FIG. 3 according to the present disclosure.

In some embodiments shown in FIG. 10, a chargeable coating 73 over superabrasive particles 71 may be a magnetic material. Coated superabrasive particle 75 may be placed on a strip 61. A wire mesh 85 may be placed proximate an opposite side of the strip 61 from the coated superabrasive particles 75. The wire mesh 85 may be electrically charged, forming a magnetic field. The coated superabrasive particles 75 may align with a portion of the resulting magnetic field. Optionally, coated superabrasive particles 75 not aligned with the magnetic field may be removed, such as by shaking, agitating, tilting, vibrating, blowing air, vacuuming, brushing, etc. Once aligned, the coated superabrasive particles 75 may be secured into place, such as by pressing, spraying with powder coat, placing another strip 61*a* over the coated superabrasive particles 75, etc.

The superabrasive particles 71 may be individually placed on a strip 61. For example, an SMT component placement system may be used to place superabrasive particles 71 in precise locations on a strip 61. In some embodiments, superabrasive particles 71 may be placed by hand, such as underneath a magnifying viewer. Once aligned, the superabrasive particles 71 may be secured into place, such as by pressing, spraying with powder coat, placing another strip 61*a* over the superabrasive particles 71, etc.

In some embodiments, the methods described above may be repeated and/or combined to provide more than one layer of superabrasive particles 71 and one or more strips 61. For example, the process may be repeated on a different surface, such as the back or opposite surface of the strip 61. In other embodiments, more than one strip 61 may be stacked and pressed together to form a green insert 91 with multiple layers of superabrasive particles 71, each distributed according to a predetermined pattern. The pattern of the superabrasive particles 71 may have uniform or varied spacing, and may be formed in a spiraled, staggered, or other pattern to produce a selected wear pattern. Combinations of different diameters of superabrasive particles 71, variation of spacing between superabrasive particles 71, different compositions and coatings of superabrasive particles 71, etc. may be used to achieve a selected wear pattern. The diameter and/or concentration of the superabrasive particles 71 (and therefore the wear pattern) may be selectively varied along dimensions of an insert for an earth-boring tool. For example, the wear pattern may be varied front-to-back, center-to-outside, top-to-bottom, or any combination thereof. The variation may be within a single strip 61 or across multiple strips 61. Thus, the present disclosure may enable formation of inserts for earth-boring tools having optimized wear rates, wear behavior, and penetration rates. For example, methods of the present disclosure may be used to form structures having anisotropic wear resistance, such as those described in Abrasive-Impregnated Cutting Structures Having Anisotropic Wear Resistance and Drag Bit Including Same, U.S. Pat. No. 7,497,280, issued Mar. 3, 2009, which is incorporated herein in its entirety by this reference.

Figure 11A:
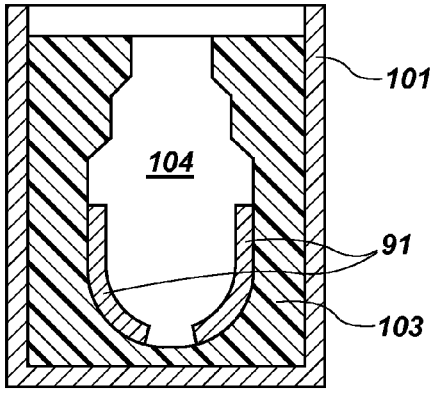
FIGS. 11A through 11C are schematic side views of a method of using the strips prepared with superabrasive particles in a predetermined pattern, as shown in FIGS. 5D, 6D, 7B, or 9D, to form a drill bit such as those in FIG. 1 or 2.
Figure 11B:
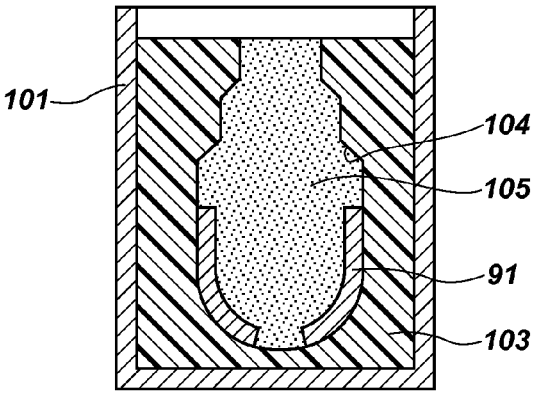
Figure 11C:
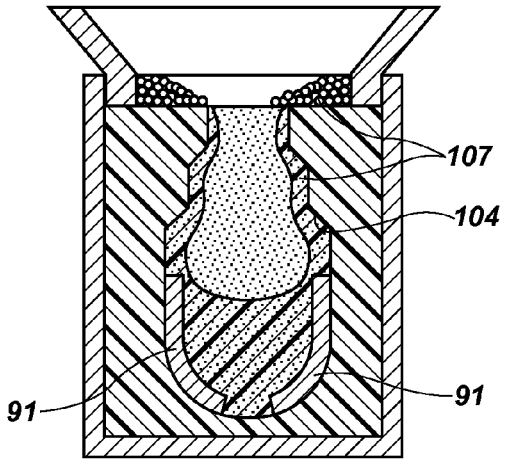

In some embodiments, the green insert 91 may next be prepared for inclusion in an abrasive application, such as in an impregnated drill bit 11. Referring to FIGS. 11A through 11C, in some embodiments, a mold casing 101 may encase a drill bit crown mold 103. One or more green inserts 91 may be placed in a drill bit crown mold 103 in locations where abrasiveness is desired, such as, for example, at a location in the mold that will become the blades 19 (see FIG. 1) or the bit gage pads 46 (see FIG. 2).

An interior 104 of the bit crown mold 103 may then be filled with one or more particulate core materials 105, as shown in FIG. 11B. Exemplary particulate core materials 105 that may be employed to form the bit body include, without limitation, tungsten carbide, other erosion- and abrasion-resistant materials, iron, steel, stainless steel, titanium, titanium alloys, nickel, nickel alloys, INVAR® alloy, other tough and ductile materials, other materials that are useful in fabricating earth-boring rotary drill bits, or combinations of any of the foregoing materials. Any surfaces of the bit body that may be exposed during drilling may comprise an erosion- and abrasion resistant material, such as tungsten carbide. These surfaces may comprise an insert 91 with a predetermined distribution of superabrasive particles 71.

Following the disposal of particulate core material or materials 105 within the interior 104 of the bit crown mold 103, as depicted in FIG. 11B, particulate core material 105 may be vibrated or otherwise compacted to facilitate the substantially complete filling of the interior 104 of the bit crown mold 103 with particulate core material 105.

Prior to infiltrating the inserts 91 and particulate core material or materials 105 with an infiltrant material, the bit crown mold 103 may be preheated at a sufficient temperature to dissipate or vaporize the binder 62 in the green inserts 91.

Preheating may be conducted in a furnace or other heating device, such as an induction coil, as is known in the art.

Turning to FIG. 11C, infiltration may be conducted at typical infiltration temperatures, for example, temperatures of from about 950° C. to about 1200° C. or hotter, at which a hardenable liquid infiltrant material 107 will liquefy and will imbibe substantially throughout the various particulate-based regions of the bit body, including the inserts 91.

A conventional infiltrant material 107, such as a copper or copper-nickel alloy or a high melting-point non-metallic binder, such as a glass-based material, may be employed to infiltrate the inserts 91 and the rest of the bit body. Alternatively, a polymeric binder, such as a polyester or an epoxy resin, may be employed to infiltrate the inserts 91 and the remainder of the bit body. In some instances, infiltration with such material may be carried out at substantially room temperature.

With continued reference to FIG. 11C, a hardenable liquid infiltrant material 107 may be placed in contact with the particulate core material 105 disposed in the mold interior 104 and mass infiltrated into the interstices between particles of the core material 105 and into the interstices of the insert or inserts 91, as is known in the art. During infiltration, the infiltrant material 107 melts and moves throughout the particulate-based regions of the core material or materials 105 and of the inserts 91.

The infiltrant material 107 is then permitted to harden and solidify, effectively binding the particles comprising the impregnated bit 11 together. As the infiltrant material 107 solidifies, it may also bind the bit body to any solid structures disposed therein, such as a bit blank or bit shank (shown in FIG. 1), resulting in a single, integral structure. The infiltrant material 107 may also fill any voids within or on the bit body. The infiltrant material 107 may also infiltrate the insert or inserts 91 and, thereby, integrate the inserts 91 with the remainder of the bit body.

Alternatively, the insert or inserts 91 may be infiltrated prior to infiltrating the remainder of the bit body. The insert or inserts 91 may subsequently be secured to the remainder of the bit body during infiltration by the infiltrant material 107 bonding to the material with which the insert 91 is infiltrated. Alternatively, the insert 91 may subsequently be secured to the remainder of the bit body by, for example, mechanical means, brazing, welding, or adhering, as will be appreciated by one of ordinary skill in the art.

In other embodiments, similar methods to those described may be used to include inserts 91 with a controlled distribution of superabrasive particles 71 in fixed-cutter bits 31, such as the fixed-cutter bit 31 shown in FIG. 2.

In yet additional embodiments, the inserts 91 may be incorporated into a green bit body, such as a pressed, green bit body, which then may be sintered to form a drill bit like that shown in FIG. 1 or that shown in FIG. 2, using methods such as those disclosed in, for example, U.S. Pat. No. 7,776,256, issued Aug. 17, 2010 to Smith et al., and U.S. Patent Application Publication No. US 2007/0102198 A1, which was filed Nov. 10, 2005, now U.S. Pat. No. 7,802,495, issued Sep. 28, 2010, in the name of Oxford et al., the disclosures of which are incorporated herein in their respective entireties by this reference.

Embodiments of the present disclosure, therefore, may find use in any application in which diamond-impregnated or superabrasive particle-impregnated materials may be used. Specifically, embodiments of the present disclosure may be used to create diamond impregnated inserts, diamond impregnated bit bodies, diamond impregnated wear pads, or any other diamond impregnated material known to those of ordinary skill in the art. Further, embodiments of the present disclosure may be used in diamond impregnated cutter wheels, diamond impregnated grinding wheels, diamond impregnated saws, diamond impregnated core drills, diamond impregnated blades, etc.

Additional non-limiting example embodiments of the disclosure are described below.

Embodiment 1: A method of forming an insert for an earth-boring tool comprising providing a material in a pattern adjacent a strip, arranging a plurality of superabrasive particles proximate the pattern, and securing at least some of the plurality of superabrasive particles to the strip. The material is configured to attract or secure the plurality of superabrasive particles.

Embodiment 2: The method of Embodiment 1, wherein securing at least some of the plurality of superabrasive particles to the strip comprises pressing at least some of the plurality of superabrasive particles into the strip.

Embodiment 3: The method of Embodiment 2, wherein providing a material in a pattern over a strip comprises placing a template having a plurality of apertures over the strip, and wherein arranging a plurality of superabrasive particles proximate the pattern comprises placing at least some of the plurality of superabrasive particle at least partially within at least some of the apertures.

Embodiment 4: The method of any of Embodiments 1 through 3, further comprising infiltrating the strip with a metallic binder after arranging the plurality of superabrasive particles.

Embodiment 5: The method of any of Embodiments 1 through 4, further comprising subjecting the strip and the superabrasive particles to a hot isostatic pressing process.

Embodiment 6: The method of any of Embodiments 1 through 5, wherein providing a material in a pattern over a strip comprises forming the material to have a plurality of recesses therein, and arranging the plurality of superabrasive particles proximate the pattern comprises disposing a superabrasive particle within each recess of the plurality of recesses in the material.

Embodiment 7: The method of any of Embodiments 1 through 6, further comprising disposing another strip over the superabrasive particles and the strip to form a sandwiched array of superabrasive particles.

Embodiment 8: The method of Embodiment 7, wherein disposing another strip over the superabrasive particles and the strip to form a sandwiched array of superabrasive particles comprises embedding at least some of the plurality of superabrasive particles into at least one of the strip and the another strip.

Embodiment 9: The method of Embodiment 7, further comprising disposing a superabrasive particle within each recess of the plurality of recesses of the another strip, and forming a third strip over the another strip and the superabrasive particles.

Embodiment 10: The method of any of Embodiments 1 through 9, wherein providing a material in a pattern over a strip comprises providing adhesive on the strip. Arranging the plurality of superabrasive particles proximate the pattern comprises disposing the plurality of superabrasive particles over the strip, such that some particles of the plurality are attracted to the adhesive, and removing particles of the plurality that are not attracted to the adhesive.

Embodiment 11: The method of any of Embodiments 1 through 10, further comprising coating each superabrasive particle of the plurality of superabrasive particles with a magnetic material and disposing a charged mesh under the strip.

Embodiment 12: A method of forming an insert for an earth-boring tool, comprising, imparting like charges to each of a plurality of superabrasive particles, placing the plurality of superabrasive particles over a strip, and securing the superabrasive particles to the strip.

Embodiment 13: The method of Embodiment 12, further comprising coating each superabrasive particle of the plurality of superabrasive particles with a chargeable material.

Embodiment 14: The method of Embodiment 12 or Embodiment 13, wherein securing the superabrasive particles to the strip comprises pressing the particles at least partially into the strip.

Embodiment 15: A method of forming an insert for an earth-boring tool, comprising placing a first plurality of superabrasive particles in an array over a first strip, placing a second strip over the first plurality of superabrasive particles, placing a second plurality of superabrasive particles in an array over the second strip, and placing a third strip over the second plurality of superabrasive particles.

Embodiment 16: The method of Embodiment 15, further comprising subjecting the strips and the superabrasive particles to a hot isostatic pressing process.

Embodiment 17: A method of forming an earth-boring rotary drill bit, comprising forming an insert and securing the insert to a body of the earth-boring rotary drill bit. Forming an insert comprises forming a material in a pattern over a strip, arranging the plurality of superabrasive particles proximate the pattern, and securing at least some of the plurality of superabrasive particles to the strip. The material in the pattern is configured to attract or secure a plurality of superabrasive particles.

Embodiment 18: The method of Embodiment 17, wherein securing the insert to a body of the earth-boring rotary drill bit comprises placing the insert in a mold for an earth-boring rotary drill bit, placing particulate core materials in the mold, and infiltrating the particulate core materials with a binder.

Embodiment 19: The method of Embodiment 18, wherein infiltrating the particulate core materials with a binder comprises placing a binder over the particulate core materials and heating the mold to melt the binder.

Embodiment 20: The method of Embodiment 19, wherein the strip comprises an organic binder and the binder comprises a metallic binder.

Embodiment 21: The method of Embodiment 3, wherein placing a template having a plurality of apertures over the substrate comprises placing a screen over the substrate.

Embodiment 22: The method of Embodiment 3, wherein placing at least some of the plurality of superabrasive particles at least partially within at least some of the apertures comprises causing at least some of the plurality of superabrasive particles to fall at least partially within the plurality of apertures in the screen by at least one of agitating, vibrating, blowing, and tilting.

Embodiment 23: The method of any of Embodiments 1 through 11, 21, or 22, further comprising forming the pattern by at least one of rapid prototyping, laser ablation, stamping, drilling, and cutting.

Embodiment 24: The method of any of Embodiments 1 through 11 or 21 through 23, further comprising mixing hard particles with a binder to form the strip.

Embodiment 25: The method of Embodiment 24, further comprising heating the strip to remove at least a substantial portion of the binder from the strip.

Embodiment 26: The method of any of Embodiments 1 through 11 or 21 through 25, further comprising sintering the strip and the superabrasive particles.

Embodiment 27: The method of Embodiment 7 or Embodiment 8, further comprising subjecting the strip, the superabrasive particles, and the another strip to a hot isostatic pressing process.

Embodiment 28: The method of any of Embodiments 7, 8, or 27, further comprising forming at least one of the material, the strip, and the another strip by at least one of rapid prototyping, laser ablation, stamping, drilling, and cutting.

Embodiment 29: The method of any of Embodiments 12 through 14, further comprising imparting the strip with a charge opposite the charge imparted to each of the plurality of superabrasive particles.

Embodiment 30: The method of any of Embodiments 12 through 14, further comprising electrically grounding the substrate before placing the plurality of charged superabrasive particles on the substrate.

Embodiment 31: The method of any of Embodiments 12 through 14, 29, or 30, wherein imparting like charges to each of a plurality of superabrasive particles comprises electrically charging the plurality of superabrasive particles with an electrostatic gun.

Embodiment 32: The method of any of Embodiments 12 through 14 or 29 through 31, wherein securing the superabrasive particles to the strip comprises forming a second strip over the superabrasive particles.

Embodiment 33: The method of Embodiment 9, wherein removing particles of the plurality that are not attracted to the adhesive comprises removing substantially all the particles except the particles attracted to the adhesive.

Embodiment 34: The method of Embodiment 9, wherein disposing a plurality of superabrasive particles over the strip comprises disposing one particle over each of a plurality of distinct areas of the adhesive.

Embodiment 35: The method of Embodiment 15 or Embodiment 16, further comprising bonding the second strip to the first strip and the third strip.

Embodiment 36: The method of any of Embodiments 15, 16, or 35, further comprising sintering the substrates and the superabrasive particles.

Embodiment 37: The method of Embodiment 18, further comprising preheating the strip to dissipate the first binder before placing particulate core materials in the mold.

Embodiment 38: The method of Embodiment 37, further comprising infiltrating the strip with a third binder before placing the strip in the mold.

Embodiment 39: The method of any of Embodiments 17 through 20, 37, or 38, further comprising infiltrating the strip with a metallic binder.

Embodiment 40: The method of any of Embodiments 17 through 20 or 37 through 39, wherein securing the insert to a body of the earth-boring rotary drill bit comprises attaching the substrate infiltrated with a metallic binder to an at least partially formed bit body by at least one of mechanical means, brazing, welding, and adhering.

Embodiment 41: An intermediate structure formed during the fabrication of an earth-boring tool, comprising a strip comprising a plurality of hard particles and a binder, a screen with a plurality of apertures therethrough placed over at least one surface of the strip, and a plurality of superabrasive particles. Each superabrasive particle of the plurality of superabrasive particles is disposed at least partially within an aperture of the plurality of apertures in the screen.

Embodiment 42: The intermediate structure of Embodiment 41, further comprising a plate disposed at least partially over the screen and the plurality of superabrasive particles, the plate configured to press the plurality of superabrasive particles at least partially into the at least one surface of the strip.

Embodiment 43: The intermediate structure of Embodiment 41 or Embodiment 42, further comprising a roller disposed at least partially over the screen and the plurality of superabrasive particles for rolling over the plurality of superabrasive particles and pressing the plurality of superabrasive particles at least partially into the at least one surface of the strip.

Embodiment 44: The intermediate structure of any of Embodiments 41 through 43, wherein the plurality of hard particles of the strip comprises a plurality of tungsten carbide particles and the binder of the strip comprises an organic binder.

Embodiment 45: The intermediate structure of any of Embodiments 41 through 44, wherein the screen comprises wires.

Embodiment 46: The intermediate structure of any of Embodiments 41 through 44, wherein the screen comprises a metal plate.

Embodiment 47: The intermediate structure of any of Embodiments 41 through 46, wherein the screen with a plurality of apertures therethrough comprises a screen with a plurality of apertures arranged according to a predetermined pattern.

Embodiment 48: The intermediate structure of Embodiment 47, wherein the predetermined pattern of the apertures is at an angle to the direction of movement during operation of the earth-boring tool during normal operating conditions.

Embodiment 49: The intermediate structure of Embodiment 47 or Embodiment 48, wherein the predetermined pattern of the apertures is irregular, with a first concentration of apertures in one area of the screen and a second concentration of apertures in another area of the screen. The first and second concentrations different from each other.

Embodiment 50: The intermediate structure of any of Embodiments 41 through 44 or 49 through 49, wherein the plurality of apertures through the screen are formed by laser ablation.

Embodiment 51: An intermediate structure formed during the fabrication of an earth-boring tool, comprising a strip comprising a plurality of hard particles and a binder, and a plurality of electrically charged superabrasive particles at least partially covering at least one surface of the strip.

Embodiment 52: The intermediate structure of embodiment 51, wherein each electrically charged superabrasive particle of the plurality of electrically charged superabrasive particles comprises a coating of a chargeable material.

Embodiment 53: The intermediate structure of embodiment 52, wherein the coating of a chargeable material comprises tungsten.

Embodiment 54: The intermediate structure of any of Embodiments 51 through 53, wherein the strip is electrically grounded.

Embodiment 55: The intermediate structure of any of Embodiments 51 through 53, wherein the strip is electrically charged with a charge opposite to the charge of the plurality of superabrasive particles.

Embodiment 56: The intermediate structure of any of Embodiments 51 through 55, further comprising a plate over the charged superabrasive particles and the at least one surface of the strip for pressing the superabrasive particles at least partially into the at least one surface of the strip.

Embodiment 57: The intermediate structure of embodiment any of Embodiments 51 through 56, wherein the plurality of electrically charged superabrasive particles comprises a plurality of diamonds.

Embodiment 58: A method of forming an insert for an earth-boring rotary drill bit, the method comprising forming a strip by mixing hard particles with a binder, arranging a plurality of superabrasive particles on a surface of the strip according to a predetermined pattern, and pressing the plurality of superabrasive particles at least partially into the surface of the strip.

Embodiment 59: The method of Embodiment 58, wherein arranging a plurality of superabrasive particles on a surface of the strip according to a predetermined pattern comprises placing a screen with a plurality of apertures arranged in a predetermined pattern over the strip, and placing a plurality of superabrasive particles over the screen such that at least some of the plurality of superabrasive particles are each disposed at least partially within each of at least some of the plurality of apertures in the screen.

Embodiment 60: The method of Embodiment 59, further comprising forming the plurality of apertures in the screen by at least one of laser ablation, stamping, drilling, and cutting.

Embodiment 61: The method of Embodiment 59 or Embodiment 60, further comprising causing the plurality of superabrasive particles to fall at least partially within the plurality of apertures in the screen by at least one of agitating, vibrating, blowing, and tilting.

Embodiment 62: The method of any of Embodiments 58 through 61, wherein arranging a plurality of superabrasive particles on a surface of the strip according to a predetermined pattern comprises electrically charging the plurality of superabrasive particles, and placing the plurality of charged superabrasive particles on the strip.

Embodiment 63: The method of Embodiment 62, further comprising coating each superabrasive particle of the plurality of superabrasive particles with a chargeable material.

Embodiment 64: The method of Embodiment 62 or Embodiment 63, further comprising electrically charging the strip with a charge opposite that of the charged superabrasive particles.

Embodiment 65: The method of Embodiment 62 or Embodiment 63, further comprising electrically grounding the strip before placing the plurality of charged superabrasive particles on the strip.

Embodiment 66: The method of any of Embodiments 62 through 65, wherein electrically charging the plurality of superabrasive particles comprises electrically charging the plurality of superabrasive particles with an electrostatic gun.

Embodiment 67: The method of any of Embodiments 58 through 66, further comprising heating the strip to remove at least a substantial portion of the binder from the strip.

Embodiment 68: The method of any of Embodiments 58 through 66, further comprising infiltrating the strip with a metallic binder after arranging the plurality of superabrasive particles on a surface of the strip according to a predetermined pattern.

Embodiment 69: The method of any of Embodiments 58 through 68, wherein pressing the plurality of superabrasive particles at least partially into the surface of the strip comprises pressing the plurality of superabrasive particles at least partially into the surface of the strip with a metal plate.

Embodiment 70: The method of any of Embodiments 58 through 69, wherein pressing the plurality of superabrasive particles at least partially into the surface of the strip comprises pressing the plurality of superabrasive particles at least partially into the surface of the strip with a roller.

Embodiment 71: The method of any of Embodiments 58 through 70, wherein arranging a plurality of superabrasive particles on a surface of the strip according to a predetermined pattern and pressing the plurality of superabrasive particles at least partially into the surface of the strip comprises arranging a plurality of diamonds on a surface of the strip according to a predetermined pattern and pressing the plurality of diamonds at least partially into the surface of the strip.

Embodiment 72: A method of forming an earth-boring rotary drill bit, comprising forming a strip by mixing hard particles with a first binder, pressing a plurality of superabrasive particles arranged in a predetermined pattern at least partially into the strip, forming the earth-boring rotary drill bit to include the strip after forming the strip, and pressing the plurality of superabrasive particles into the strip.

Embodiment 73: The method of Embodiment 72, wherein forming the earth-boring rotary drill bit comprises placing the strip in a mold for an earth-boring rotary drill bit, placing particulate core materials in the mold, and infiltrating the particulate core materials with a second binder.

Embodiment 74: The method of Embodiment 73, further comprising preheating the strip to dissipate the first binder before placing the particulate core materials in the mold.

Embodiment 75: The method of Embodiment 74, further comprising infiltrating the strip with a third binder before placing the strip in the mold.

Embodiment 76: The method of any of Embodiments 73 through 75, wherein infiltrating the particulate core materials with a second binder comprises placing a second binder over the particulate core materials and heating the mold to melt the second binder.

Embodiment 77: The method of any of Embodiments 73 through 76, wherein the first binder comprises an organic binder and the second binder comprises a metallic binder.

Embodiment 78: The method of any of Embodiments 72 through 77, further comprising infiltrating the strip with a metallic binder.

Embodiment 79: The method of any of Embodiments 72 through 78, wherein forming the earth-boring rotary drill bit to include the strip after forming the strip and pressing the plurality of superabrasive particles into the strip comprises attaching the strip infiltrated with a metallic binder to an at least partially formed bit body by at least one of mechanical means, brazing, welding, and adhering.

Embodiment 80: The method of Embodiment 1, further comprising selectively varying at least one of a diameter and a concentration of the superabrasive particles along a dimension of the insert for an earth-boring tool.

Embodiment 81: The method of Embodiment 80, further comprising selecting the dimension from the group consisting of a front-to-back dimension, a center-to-outside dimension, and a top-to-bottom dimension.

While the present invention has been described herein with respect to certain embodiments, those of ordinary skill in the art will recognize and appreciate that it is not so limited. Rather, many additions, deletions, and modifications to the embodiments depicted and described herein may be made without departing from the scope of the invention as hereinafter claimed, and legal equivalents. In addition, features from one embodiment may be combined with features of another embodiment while still being encompassed within the scope of the invention as contemplated by the inventor. Further, embodiments of the disclosure have utility in drill bits having different bit profiles as well as different cutter types.

What is claimed is:

1. A method of forming an insert for an earth-boring tool, comprising:

forming a strip having a plurality of recesses therein, the strip configured to attract or secure a plurality of superabrasive particles;

after forming the strip having a plurality of recesses therein, disposing the plurality of superabrasive particles within the plurality of recesses;

securing at least some of the plurality of superabrasive particles within the recesses of the stip and forming an assembly including the strip having the plurality of recesses therein and the plurality of superabrasive particles secured within the recesses of the strip; and at least one of sintering the assembly, infiltrating the assembly with a metallic binder, and curing the assembly to form the insert for an earth-boring tool.

2. The method of claim 1, wherein securing at least some of the plurality of superabrasive particles within recesses of the strip comprises pressing at least some of the plurality of superabrasive particles into the strip.

3. The method of claim 1, wherein at least one of sintering the assembly, infiltrating the assembly with a metallic binder, and curing the assembly comprises infiltrating the assembly with a metallic binder after securing the plurality of superabrasive particles.

4. The method of claim 1, wherein disposing the plurality of superabrasive particles within the plurality of recesses comprises disposing a superabrasive particle within each recess of the plurality of recesses in the strip.

5. The method of claim 1, further comprising disposing another strip over the superabrasive particles and the strip to form a sandwiched array of superabrasive particles.

6. The method of claim 5, wherein disposing another strip over the superabrasive particles and the strip to form a sandwiched array of superabrasive particles comprises embedding at least some of the plurality of superabrasive particles into at least one of the strip and the another strip.

7. The method of claim 5, further comprising:

disposing a superabrasive particle within each recess of a plurality of recesses of the another strip; and forming a third strip over the another strip and the superabrasive particles.

8. The method of claim 5, further comprising forming at least one of the strip and the another strip by rapid prototyping.

9. The method of claim 5, wherein disposing another strip over the superabrasive particles and the strip comprises aligning recesses of a lower surface of the another strip with the plurality of recesses of the strip.

10. The method of claim 1, further comprising coating each superabrasive particle of the plurality of superabrasive particles with a magnetic material and disposing a charged mesh under the strip.

11. The method of claim 1, further comprising selectively varying at least one of a diameter and a concentration of the superabrasive particles along a dimension of the insert for an earth-boring tool.

12. The method of claim 11, further comprising selecting the dimension from the group consisting of a front-to-back dimension, a center-to-outside dimension, and a top-to-bottom dimension.

13. A method of forming an insert for an earth-boring tool, comprising:

coating each of a plurality of superabrasive particles with approximately 5 to 10 microns of a chargeable metal coating;

imparting like charges to the plurality of superabrasive particles;

placing the plurality of superabrasive particles over a strip; and securing the plurality of superabrasive particles to the strip by one of charging conductive hard particles within the strip or electrically grounding the strip.

14. A method of forming an earth-boring rotary drill bit, comprising:

forming an insert, comprising:

forming a strip having a plurality of recesses therein, the strip configured to attract or secure a plurality of superabrasive particles;

after forming the strip having a plurality of recesses therein, disposing the plurality of superabrasive particles within the plurality of recesses;

securing at least some of the plurality of superabrasive particles within recesses of the strip and forming an assembly including the strip having the plurality of recess therein and the plurality of superabrasive particles secured within the recesses of the strip; and at least one of sintering the assembly, infiltrating the assembly with a metallic binder, and curing the assembly; and securing the insert to a body of the earth-boring rotary drill bit.

15. The method of claim 14, wherein securing the insert to a body of the earth-boring rotary drill bit comprises:

placing the insert in a mold for an earth-boring rotary drill bit;

placing particulate core materials in the mold; and infiltrating the particulate core materials with a binder.

16. The method of claim 15, wherein the strip comprises an organic binder and the binder comprises a metallic binder.

17. The method of claim 13, wherein charging conductive hard particles within the strip comprises electrically charging the entire strip.

* * * * *